US005141473A

United States Patent [19]

Swaney

[11] Patent Number: 5,141,473

[45] Date of Patent: Aug. 25, 1992

[54] AIR DIFFUSER ASSEMBLY

[76] Inventor: Russel P. Swaney, 1333 Lennox, East Grand Rapids, Mich. 49506

[21] Appl. No.: 805,574

[22] Filed: Dec. 10, 1991

[51] Int. Cl.[5] ..... F24F 13/072

[52] U.S. Cl. ..... 454/299; 454/301

[58] Field of Search ..... 454/292, 301, 303, 304, 454/299

[56] References Cited

U.S. PATENT DOCUMENTS

| | | | |
|---|---|---|---|
| 3,406,623 | 10/1968 | Lambert | 454/303 |
| 3,577,904 | 5/1971 | Lambert | 454/301 |
| 3,757,668 | 9/1973 | Dean | 454/301 |
| 3,918,354 | 11/1975 | Lambert | 454/304 |

*Primary Examiner*—Robert G. Nilson
*Attorney, Agent, or Firm*—Reising, Ethington, Barnard, Perry & Milton

[57] ABSTRACT

An air diffuser assembly (20) for diffusing conditioned air from an air plenum (22) between adjacent ceiling tiles (32) in a suspended ceiling (24) supported by a plurality of crossing T-shaped support bars (26, 28) comprises a plurality of longitudinally extending air diffuser blades (38) for directing the conditioned air through the diffuser assembly (20). The blades (38) include first (40) and second (42) ends interconnected by first (44) and second (46) end caps respectively and defining an air flow channel (48) therebetween. Each of the end caps (44, 46) includes an engagement flange (56) for engaging a T-shaped support bar (28) to support the diffuser assembly (20) thereon and a blockage flange (54) for engaging a like adjacent blockage flange (54) of an adjacent air diffuser (20) supported on the same T-shaped support bar (28) and creating an air barrier for covering the T-shaped support bar (28) and preventing the flow of conditioned air between the adjacent diffuser assemblies (20).

28 Claims, 8 Drawing Sheets

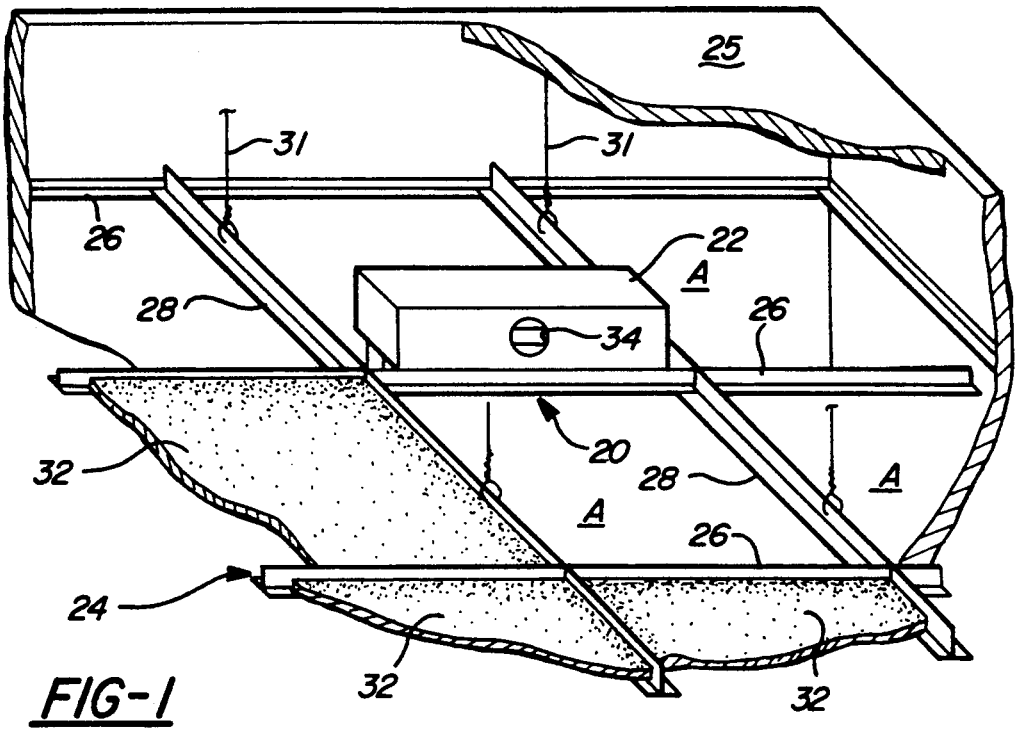
FIG-1
FIG-3
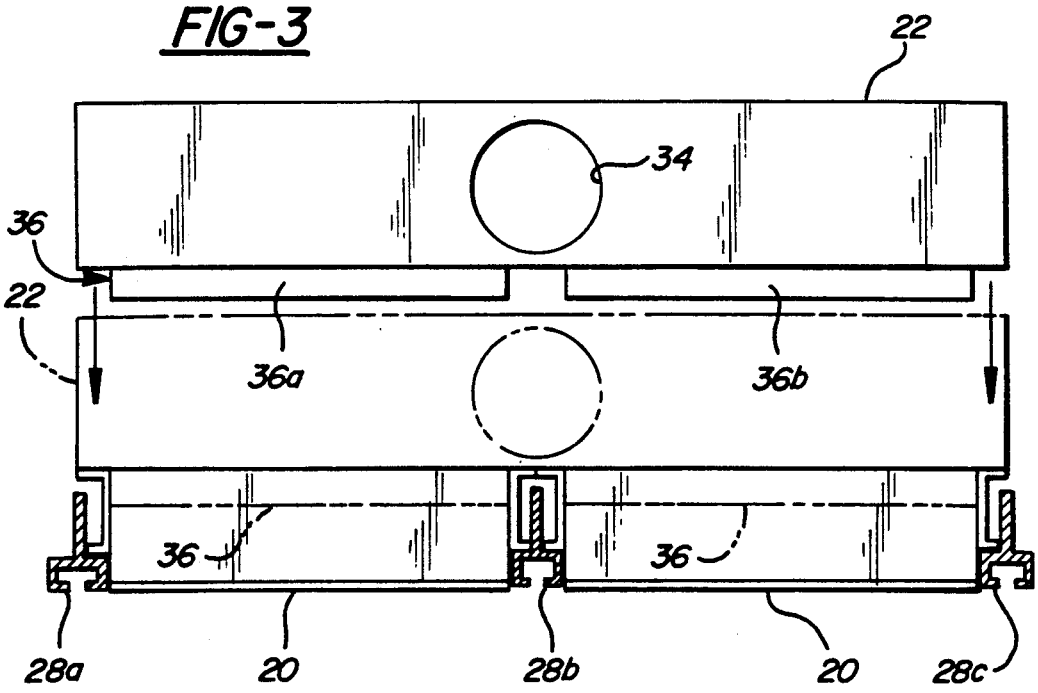

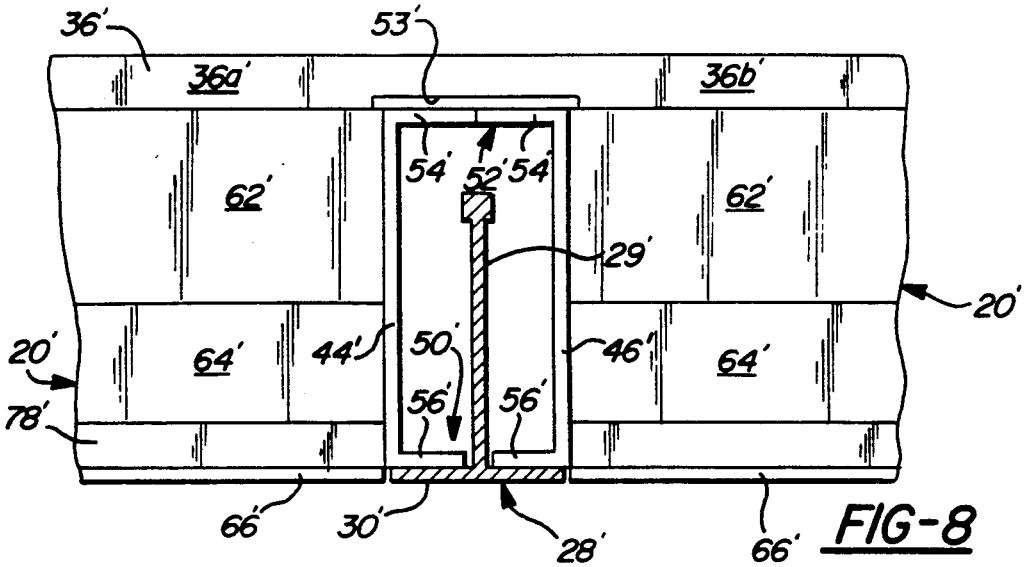
FIG-8
FIG-11
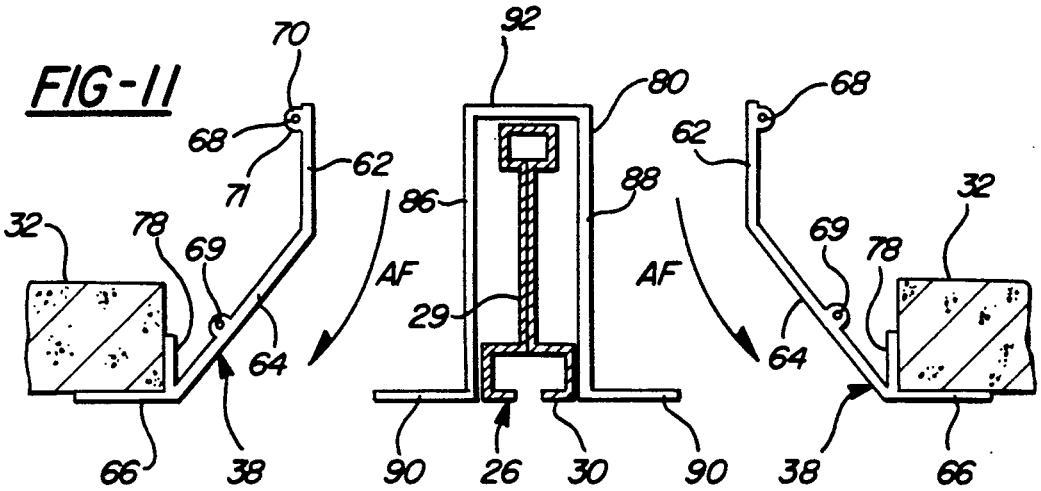
FIG-13
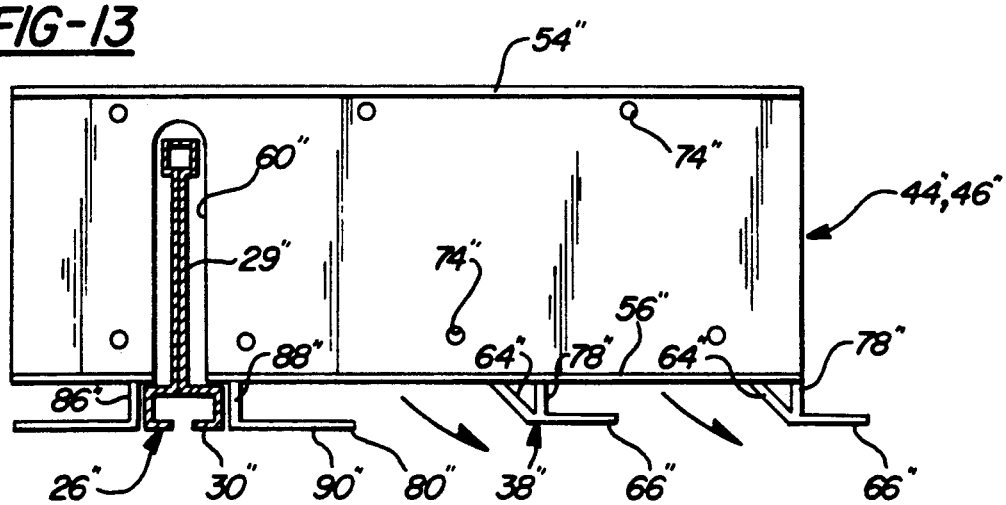

AIR DIFFUSER ASSEMBLY

BACKGROUND OF THE INVENTION

1. Technical Field

The subject invention relates generally to an air diffuser assembly and more specifically, to an air diffuser assembly supported on a T-shaped support bar in a suspended ceiling.

2. Background Art

By way of background, office buildings and the like commonly comprise a suspended ceiling spaced below and supported by an upper permanent ceiling. The space provided between the two ceilings facilitates the housing of various electrical, plumbing, heating and cooling structures required for the area occupied beneath the ceiling. The suspended ceiling generally includes a plurality of longitudinally extending spaced apart T-shaped support bars crossing transversely over similarly spaced apart T-shaped support bars forming a grid of generally square or rectangular sections to receive and support acoustical ceiling tiles as are commonly known in the art.

An air distribution system is commonly disposed in the ceiling space for dispersing conditioned air throughout the area below the suspended ceiling. An air plenum receives air from air ducts and supplies the conditioned air to an air diffuser assembly for dispersement from the ceiling into the area therebelow. Generally, the air diffuser assembly and plenum are positioned longitudinally along one of the T-shaped support bars and supported on opposite ends between adjacent spaced apart transverse T-shaped support bars.

For example, U.S. Pat. No. 3,406,623 to Lambert, issued Oct. 22, 1968 discloses a plenum air diffuser assembly adapted for use in a suspended ceiling composed of T-shaped support bars supporting a plurality of acoustic ceiling tiles. The plenum air diffuser assembly comprises a rear wall having an upper portion defining part of the plenum and a lower portion defining part of the air diffuser. The lower portion of the wall is turned inwardly to provide a flange to rest longitudinally along the length of a T-shaped support bar extending between adjacent transverse T-shaped support bars. In an alternative embodiment, the plenum air diffuser assembly includes two diffuser outlets centrally separated by a longitudinal T-shaped support bar. In this embodiment, the assembly is supported by its opposite ends on the transverse T-shaped support bars.

Similarly, the U.S. Pat. No. 3,757,668 to Dean, Jr., issued Sep. 11, 1973 discloses an air diffuser assembly including a housing for receiving conditioned air from an air supply duct and a lower diffuser portion for dispersing the air beneath a suspended ceiling. The lower diffuser portion comprises a plurality of directional plates space apart and forming a longitudinal air flow channel. The air diffuser is displaced adjacent and parallel to longitudinally extending inverted T-shaped support bars of a suspended ceiling such that the conditioned air may be dispersed therebeneath. The air flow channel includes first and second ends closed by first and second end caps. The end caps matingly engage transverse T-shaped support bars on opposite ends of the assembly to support the diffuser thereon.

The prior art air diffuser assemblies are deficient in that it is often desirable to provide a longitudinal air plenum having a continuous air outlet extending the length of several longitudinal adjacent air diffuser assemblies support at opposite ends between adjacent transverse T-bars. However, the continuous air plenum outlet will disperse air not only to the air diffuser air flow channels but also into the gap created between the ends of the adjacent air diffuser assemblies supported by the transverse T-bar. Therefore, to facilitate uniform air distribution from the air diffusers, the air gap created between the adjacent air diffusers along the transverse T-bars must be block such that conditioned air is prevented from flowing between the adjacent diffusers and restricted to flowing in the air flow channel of the air diffusers exclusively.

SUMMARY OF THE INVENTION AND ADVANTAGES

In accordance with the present invention there is provided an air diffuser assembly for receiving conditioned air from an air plenum and dispersing the air between adjacent ceiling tiles in a suspended ceiling supported by a plurality of crossing T-shaped support bars, the assembly comprises a plurality of longitudinally extending air diffuser blades for disposition in the conditioned air flow and each blade having a first and second end. A first end cap interconnects each of the first ends of the air diffuser blades for defining a first end of an air flow channel and a second end cap similarly interconnects each of the second ends of the air diffuser blades for defining a second end of the air flow channel. The assembly is characterized by each of the first and second end caps including engagement means adjacent the bottom thereof for engaging a T-shaped support bar and blockage means adjacent the top thereof for engaging blockage means of a next adjacent diffuser having its engagement means supported on the same T-shaped support bar for covering the T-shaped support bar and preventing the loss of air flow between the adjacent assemblies.

FIGURES IN THE DRAWING

Other advantages of the present invention will be readily appreciated as the same becomes better understood by reference to the following detailed description when considered in connection with the accompanying drawings wherein:

FIG. 1 is a fragmentary perspective view of a corner of a suspended ceiling facilitating an air plenum and an air diffuser assembly according to the subject invention;

FIG. 3 is a side view of the air plenum as received by the adjacent air diffuser assemblies;

FIG. 8 is a fragmentary side view of the air diffuser assembly of the alternative embodiment of FIG. 5 abutting a next adjacent air diffuser assembly and supported on the same T-shaped support bar;

FIG. 11 is an end view of the preferred embodiment of the subject invention with the end cap removed and a T-shaped support bar extending longitudinally through the center diffuser channel;

FIG. 13 is an end view of the alternative embodiment of FIG. 12 with the end cap connected;

DETAILED DESCRIPTION OF THE DRAWINGS

Figure 5:
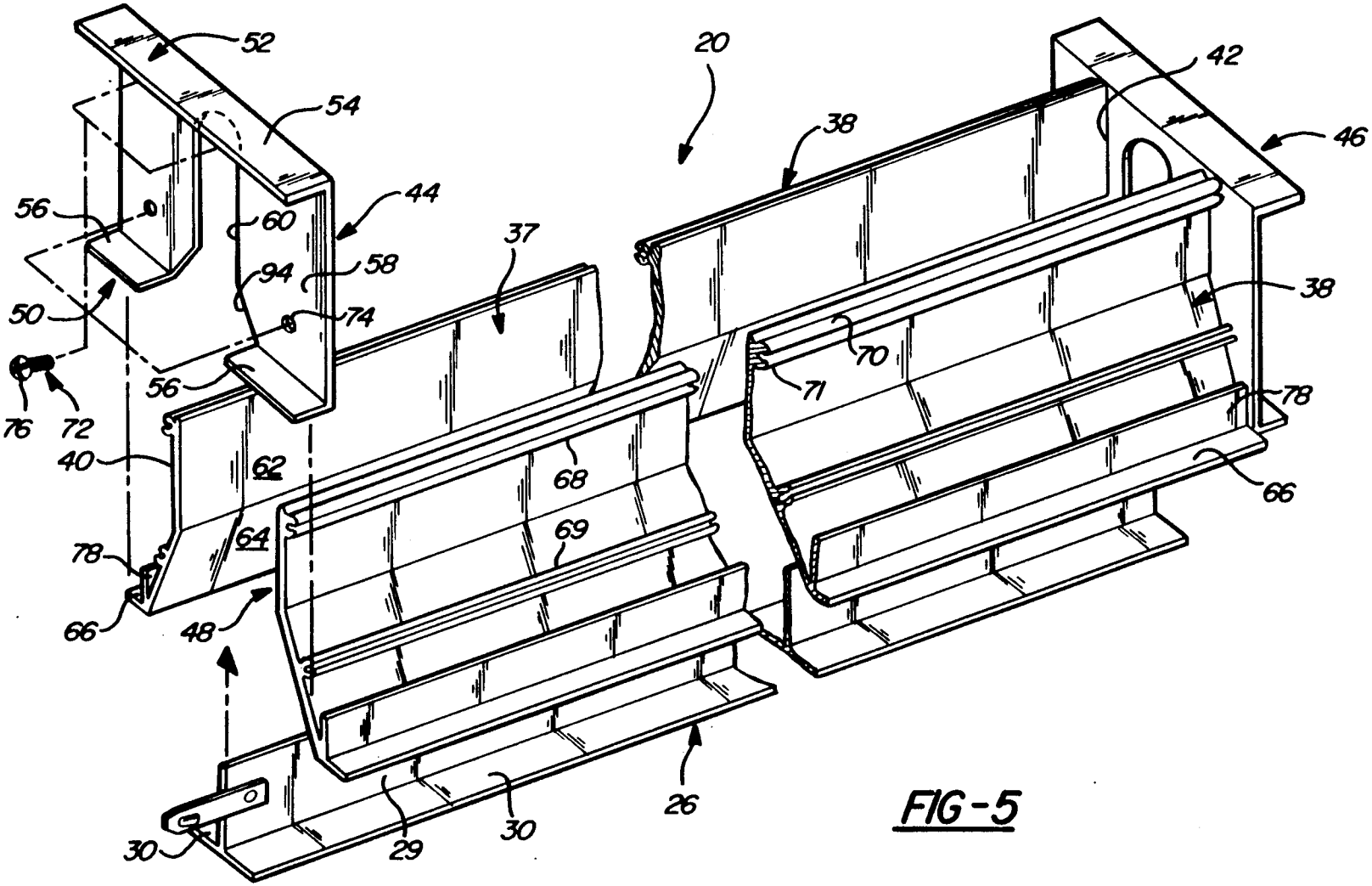
FIG. 5 is a partially exploded perspective view of an alternative embodiment of the subject invention in association with a T-shaped support bar.

Referring to the Figures wherein like numerals indicate like or corresponding parts throughout the several views, an air diffuser assembly 20 for receiving conditioned air from an air plenum 22 is generally shown in its environment in FIG. 1. Commonly, large office buildings and the like include drop or suspended ceilings 24 spaced below a permanent ceiling 25 to facilitate the hidden placement of electrical, plumbing, heating and cooling components required in the particular building. As is shown in FIG. 1, the suspended ceiling 24 includes a plurality of crossing support bars 26, 28 having an inverted T-shaped cross-section and referred to hereinafter as T-shaped support bars or T-bars 26,28. The T-bars 26, 28 are supported below the permanent ceiling 25 by a plurality of support cables 31. A first set of T-bars 26 are positioned longitudinal to the air diffuser assembly 20 in parallel spaced apart rows. The first set of T-bars 26 intersect a second set of transverse T-bars 28 in parallel spaced apart crossing columns. The intersection of the T-bars 26, 28 forms generally square or rectangular sections A of a ceiling grid pattern. Each square or rectangular section A of the ceiling 24 receives an acoustic ceiling tile as partially shown at 32 to provide an aesthetic ceiling as is commonly known in the art. Each of the T-shaped bars 26, 28, as shown in FIG. 5, includes a vertical portion 29 and a horizontal support flange 30 extending outwardly from each side of the vertical portion 29 to support a ceiling tile 32 or air diffuser 20 thereon.

Further shown in FIG. 1, is an air plenum 22 and diffuser assembly 20 supported by at least one of the T-shaped support bars 26, 28. As shown in the preferred embodiment, the assembly 20 and plenum 22 extend longitudinally along one of the support bars 26 and are supported at opposite ends between adjacent parallel transverse support bars 28. The air plenum 22 is generally rectangular in shape and constructed in the preferred embodiment from galvanized sheet metal. However it is also common to construct the air plenum 22 from sheets of fiberglass duct board as is commonly known in the heating and cooling industry.

Figure 2:
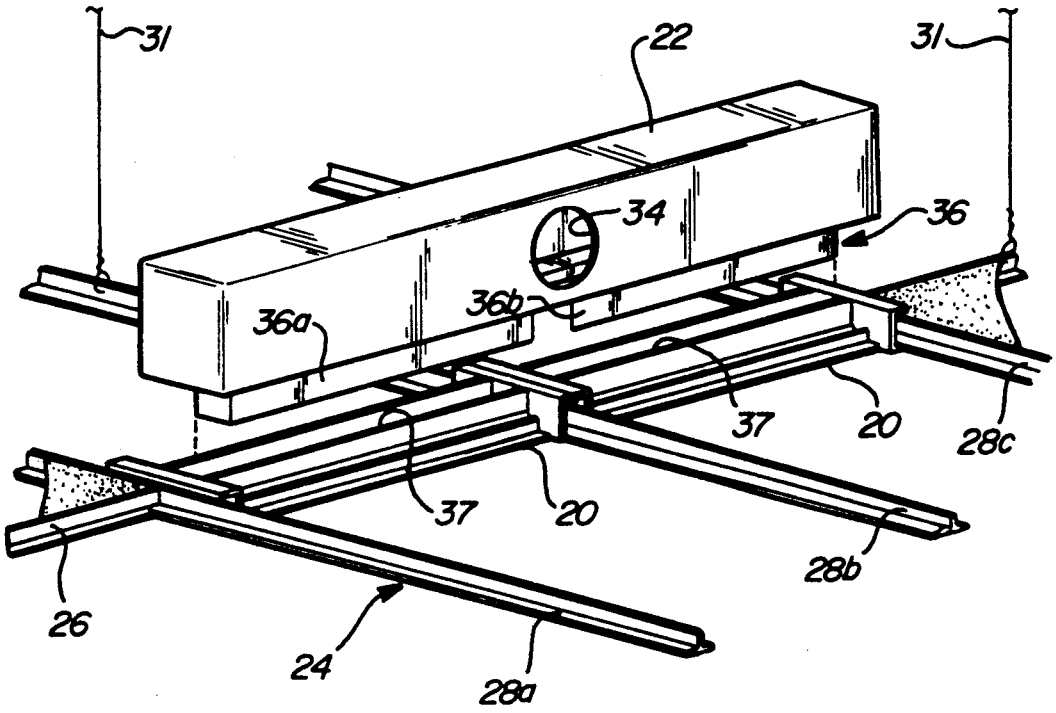
FIG. 2 is a fragmentary perspective view of a suspended ceiling facilitating an air plenum and two adjacent air diffuser assemblies according to the subject invention.

The air diffuser assembly 20 and plenum 22 may be positioned longitudinally over one of the T-shaped support bars 26 and between two adjacent transverse T-shaped support bars 28 as in FIG. 1. Alternatively, the assembly 20 and plenum 22 may be positioned between two spaced apart adjacent T-shaped support bars 26 while still supported at its opposite ends by two adjacent transverse support bars 28, not shown. However, it is also commonly desired to increase the flow and dispatch of conditioned air from the air plenum 22 by increasing the length of the plenum 22 thus increasing the volume of air flow. For example, as shown in FIG. 2, the preferred embodiment of the subject invention provides an air plenum 22 extending longitudinally along a T-bar 26 between three spaced apart transverse T-bars 28*a*, 28*b*, 28*c*, and thus crossing over the middle transverse T-bar 28*b*. The increased length of the air plenum 22 provides an increase in conditioned air flow into the area below the suspended ceiling 24.

Referring to FIGS. 2 and 3, the generally rectangular air plenum 22 is shown including a circular inlet 34 for receiving conditioned air from an air duct (not shown). The air plenum 22 further includes a generally rectangular air outlet 36 extending outwardly from the bottom of the plenum 22 and extending longitudinally along the entire length of the plenum 22. The air plenum outlet 36 is notched in the center to create a gap to extend over the crossing T-shaped support bar 28*b* and further to create spaced apart outlet flanges 36*a*, 36*b* to be received by adjacent air diffuser assemblies 20. As shown in the figures, an air diffuser assembly 20 of the preferred embodiment of FIGS. 2 and 3 is placed longitudinally along the T-bar 26 between transverse T-bars 28*a* and 28*b* and a like air diffuser assembly 20 is similarly placed longitudinally along the T-bar 26 between the transverse T-bars 28*b* and 28*c*. Alternatively, the assemblies 20 may be positioned between spaced apart adjacent T-bars 26 as previously discussed. Each of the air diffuser assemblies 20 includes an air inlet 37 for receiving the flange portion 36*a*, 36*b* of the air plenum outlet 36 extending between the respective transverse T-bars 28*a*, 28*b*, 28*c*.

Figure 4:
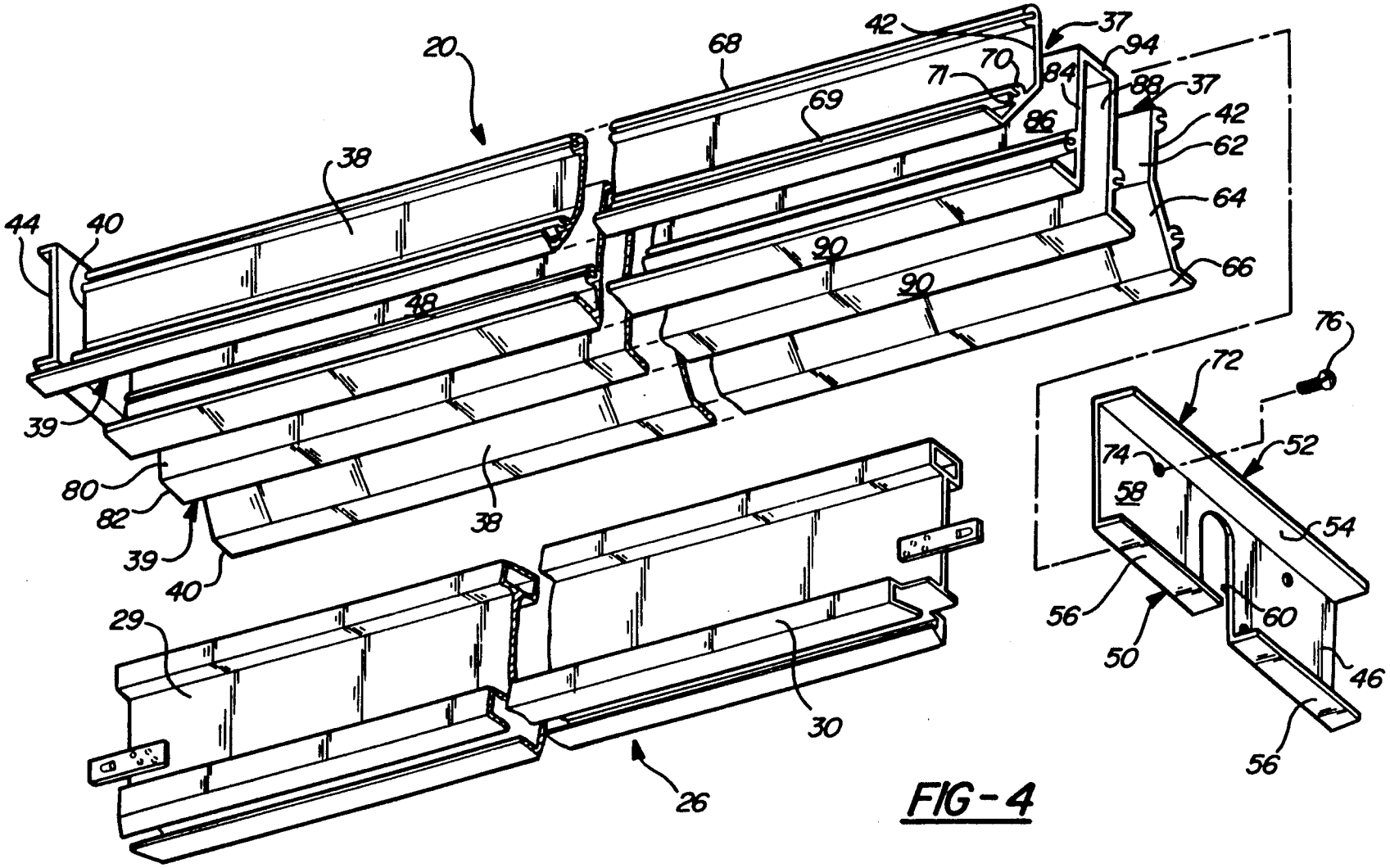
FIG. 4 is a partially exploded perspective view of the preferred embodiment of the subject invention in association with a T-shaped support bar.

Referring to FIG. 4, the preferred embodiment of the subject invention is shown including an air diffuser assembly 20 constructed from galvanized sheet metal or the like. The assembly 20 comprises a plurality of longitudinally extending air diffuser blades 38 for disposition in the conditioned air flow and each blade 38 having a first 40 and second 42 end. A first end cap 44 interconnects each of the first ends 40 of the air diffuser blades 38 for defining a first end of an air flow channel 48. Similarly, a second end cap 46 interconnects each of the second ends 42 of the air diffuser blades 38 for defining a second end of the air flow channel 48. The air flow channel 48 directs conditioned air through the assembly 20 and disperses the air from at least one diffuser outlet 39 to the area beneath the ceiling 24. The diffuser assembly 20 is characterized by each of the first 44 and second 46 end caps including engagement means 50 adjacent the bottom of the end caps 44, 46 for engaging a T-shaped support bar 28 and blockage means 52 adjacent the top portion of the end caps 44, 46 for engaging blockage means 52 of a next adjacent diffuser 20 having its engagement means 50 supported on the same T-shaped support bar 28 for covering the T-shaped support bar 28 and preventing the loss air flow between the adjacent assemblies 20.

Figure 6:
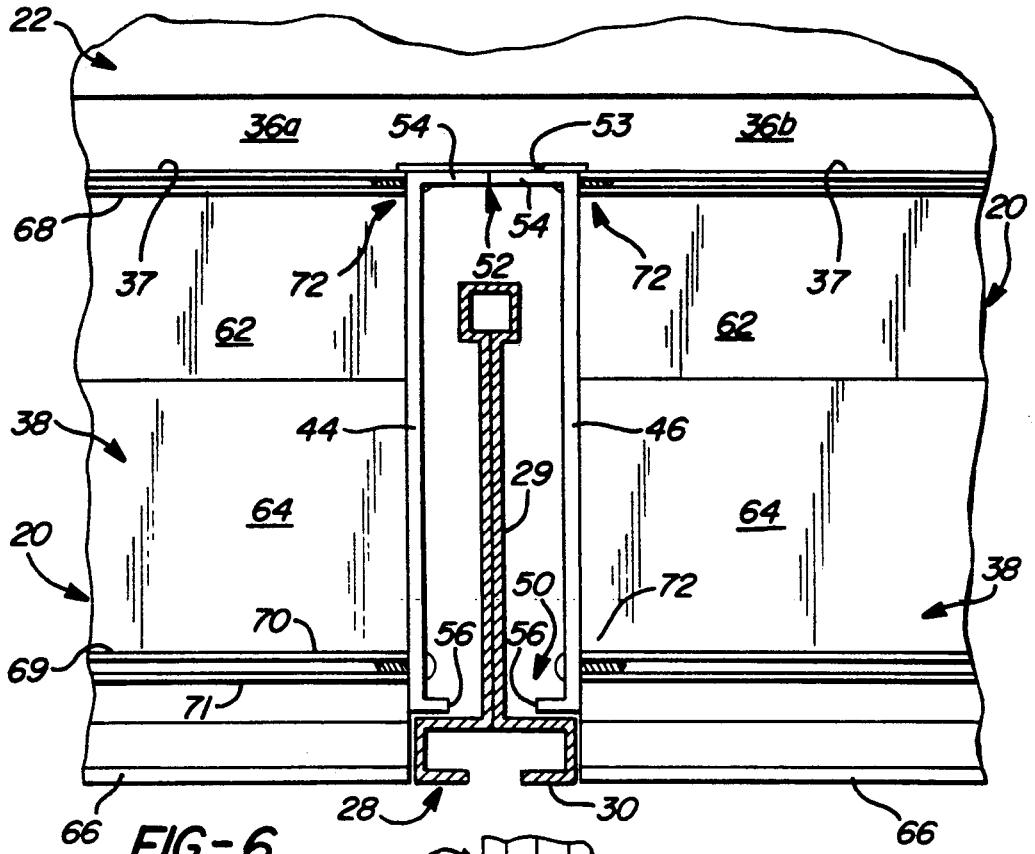
FIG. 6 is a fragmentary side view of the air diffuser assembly of the preferred embodiment of FIG. 4 abutting a next adjacent air diffuser assembly and supported on the same T-shaped support bar.
Figure 7:
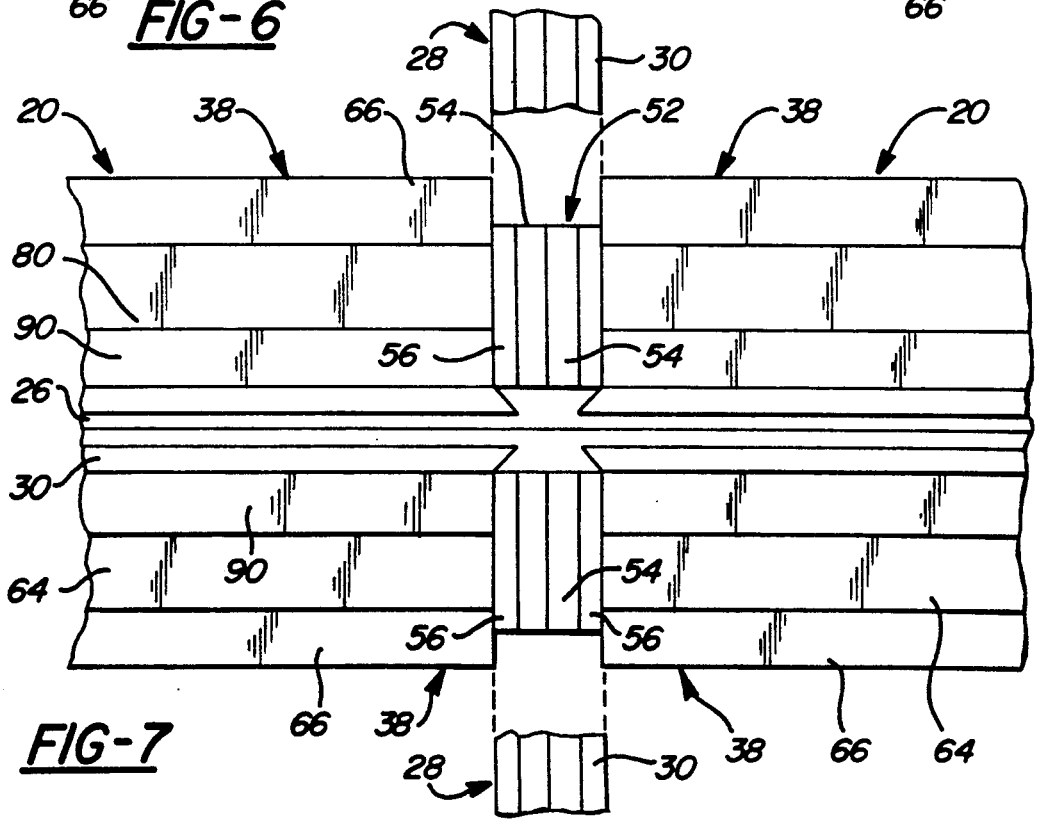
FIG. 7 is a fragmentary bottom view of a T-shaped support bar extending axially through a center diffuser channel of adjacent diffuser assemblies.
Figure 9:
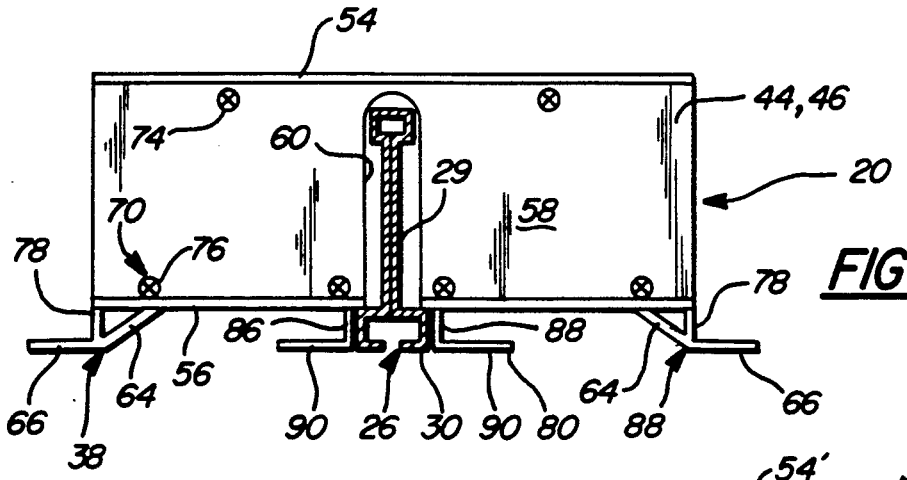
FIG. 9 is an end view of the preferred embodiment of the subject invention.

Referring to FIGS. 6 and 7, end caps 44, 46 of two longitudinally adjacent air diffuser assembly 20 are shown supported on the same T-shaped support bar 28. A portion of the plenum outlet flanges 36a, 36b are shown in fluid communication with the respective air diffuser inlets 37. As shown at 53, an air gap is created by the notched plenum outlet 36 between the adjacent end caps 44, 46 of the air diffuser 20. Therefore, the blockage means 52 includes a blockage flange 54 having a predetermined width and extending axially outwardly from the top portion of each of the end caps 44, 46 for engaging a like adjacent blockage flange 54 of an adjacent diffuser 20 creating an air barrier for preventing the flow of conditioned air between the adjacent air diffuser assemblies 20. The blockage flanges 54 of the adjacent diffuser end caps 44, 46 abut end to end to create the air barrier wall closing the air gap at 53 between the plenum air outlets 36a, 36b and thus blocking the flow of conditioned air between the adjacent diffusers 20 and exclusively restricting the flow to the air flow inlets 37 and channels 48 of the diffusers 20.

The engagement means 50 includes an engagement flange 56 having a predetermined width less than the blockage flange 54 and extending axially outwardly from the bottom portion of each of the end caps 44, 46 creating a clearance space between the engagement flange 56 and a like adjacent engagement flange 56 for receiving the T-shaped support bar 28 therebetween. As shown in FIG. 6, the larger width of the abutting blockage flanges 54 prevents the smaller width engagement flanges 56 from engaging, thus the clearance space or gap therebetween results. The vertical portion 29 of the transverse T-bar 28 is received in the gap between the engagement flanges 56 and extended between the end caps 44, 46 of the adjacent diffusers 20. The engagement flange 56 of the end cap 44 engages the horizontal support flange 30 of the T-bar 28 to support the assembly 20. Similarly, the engagement flange 56 of the end cap 46 engages the opposite horizontal support flange 30 of the T-bar 28 to support the adjacent diffuser assembly 20 on the same transverse T-bar 28. As will be further noticed, the diffuser blades 38 extend below the engagement flanges 56, such that, when the T-bar 28 engages the flanges 56, the thickness of the T-bar horizontal support flanges 30 equals the distance between the flanges 56 and the end of the diffuser blades 38. Therefore, the bottom surface of the T-bar horizontal flanges 30 will be flush with the bottom surface of the diffuser blades 38 to provide an aesthetic ceiling configuration. As will be appreciated, the positioning of the end caps 44, 46 may vary to accommodate different thickness and shapes of the T-bar flanges as will be further illustrated hereinbelow.

As shown in the Figures, each of the first 44 and second 46 end caps includes a vertical face plate 58 for supporting the engagement flange 56 and the blockage flange 54 and for connecting and supporting each of the first 40 and second 42 ends of the air diffuser blades 38 respectively. In the preferred embodiment of FIG. 4, each of the face plates 58 includes a generally U-shaped slot 60 extending upwardly from the bottom portion of the end cap 44, 46 through the engagement flange 56 to a position spaced below the blockage flange 54 at the top portion of the end cap 44, 46. The U-shaped slot 60 receives a T-shaped support bar 26 vertically therethrough as the diffuser assembly 20 is positioned axially therealong.

The air diffuser blades 38 include a first portion 62 extending between the end caps 44, 46 and further extending vertically downwardly from the top portion of the end caps 44, 46 and providing the air diffuser inlet 37 to the air flow channel 48. A second portion 64 extends outwardly from the first portion 62 at a predetermined angle to a position adjacent the bottom portion of the end caps 44, 46. The first and second portions 62, 64 form a directional wall for directing the air flow through the air flow channel 48. A third portion 66 extends outwardly from the second portion 64 perpendicular to the first portion 62 and horizontally parallel with the end cap flanges 54, 56. The third portion 66 is spaced vertically below the engagement flange 56 to enable flush alignment with the T-shaped support bar 28 as previously described. Each of the air diffuser blades 38 further includes at least one semi-cylindrical channel 68, 69 extending longitudinally along the outer surface of the diffuser blade 38 between the first and second blade ends 40, 42. More specifically, the channel 68, 69 includes a first arcuate side wall 70 and second arcuate side wall 71 spaced apart and forming a cylindrical gap or channel therebetween extending longitudinally the length of the diffuser blade 38. As shown in the preferred embodiment in FIG. 4, a first channel 68 is positioned along the top of the first portion 62 of the diffuser blade 38 and a second channel 69 is positioned along the second portion 64 of the blade 38. The channels 68, 69 are generally extruded along the outside surface of the diffuser blades 38.

The air diffuser assembly 20 includes connection means 72 for interconnecting the first 44 and second 46 end caps with the first 40 and second 42 ends of the air diffuser blades 38 respectively. The connection means 70 includes a plurality of apertures 74 extending through each of the end cap face plates 58 and in alignment with the longitudinal diffuser blade channels 68, 69 and a plurality of fasteners 76, such as screws, extending through each of the apertures 74 and threadably received in the cylindrical channels 68, 69 for interconnecting the end caps 44, 46 to the ends 40, 42 of the diffuser blades 38.

Referring to FIG. 11, the end view of a diffuser assembly 20 is shown with the end cap 44, 46 removed. Abutment means 78 are shown extending from the third portion 66 of the blades 38. The abutment means 78 includes a flange extending vertically upwardly from the third portion 66 parallel with the first portion 62 and extending longitudinally between the first and second diffuser blade ends 40, 42. The third portion 66 of the diffuser blades 38 receives and supports a portion of a ceiling tile 32 and the abutment flange 78 abuts against the edge of the ceiling tile 32 to prevent displacement thereof. In other words, the abutment flange 78 prevents the ceiling tile from shifting out of placement along the second 64 or third 66 portions of the diffuser blade 38.

Referring to the preferred embodiment of FIG. 4, the diffuser assembly 20 further includes a longitudinally extending center diffuser member 80 for disposition in the conditioned air flow. The diffuser member 80 is disposed between the diffuser blades 38 extending between the first and second end caps 44, 46 and includes a first end 82 connected to the first end cap 44 by the connection means 70 and a second end 84 connected to the second end cap 46 by similar connection means 70.

The center diffuser member 80 includes spaced apart first 86 and second 88 side walls extending downwardly into the air flow channel 48 from the top portion of the end caps 44, 46 to the position spaced below the engagement flange 56 of each end cap 44, 46 dividing the air flow channel 48 into a plurality of air diffuser outlets 39. Each of the first 86 and second 88 side walls includes a generally horizontal directional plate 90 extending perpendicularly outwardly from the bottom of each wall 86, 88 and parallel with the third portion 66 of the diffuser blades 38 for directing the conditioned air out of the air flow channel 48. A top end plate 92 interconnects the top portions of the first 86 and second 88 sidewalls creating a generally U-shaped channel therebetween. The channel between the side walls 86, 88 receives a longitudinal T-shaped support bar 26 axially therethrough as shown best in FIGS. 7 and 11. The channel formed between the side walls 86, 88 receives the vertical shank portion 29 of the T-bar 26 and the width of the channel is slightly larger than the width of the horizontal plate 30 such that the horizontal support plates 30 are seated with the bottom surface flush with the surface of the directional plates 90 of the center member 80. The center diffuser member 80 may be used in the diffuser assembly 20 to direct the flow of air through the air flow channel 48 in circumstances where the width of the horizontal support plates 30 of the T-bar 26 are not wide enough to be additionally used as air diffuser blades.

For example, in an alternative embodiment as shown in FIG. 5 wherein like numerals indicate like or corresponding parts with an additional primed denotation, the center diffuser member 80 of the preferred embodiment is substituted by a T-shaped support bar 26' extending axially between the first and second end caps 44', 46'. The support bar 26' of FIG. 5 likewise includes a vertical shank portion 29' extending vertically into the air flow channel 48' and horizontal directional plates 30' extending outwardly on each side of the vertical portion 29' into the air flow channel 48' to direct the conditioned air flow out of the diffuser assembly 20'.

The alternative embodiment of FIG. 5 is otherwise substantially similar to the preferred embodiment of FIG. 4. The air diffuser assembly 20' includes two longitudinal air diffuser blades 38' spaced apart and including first 40' and second 42' blade ends. Each of the first 40' blade ends are interconnected by a first end cap 44' and the second blade ends similarly connected by a second end cap 46' forming an air flow channel 48' extending longitudinally between the first 40' and second 42' ends. Connection means 70' comprising apertures 74' passing through the face 58' of the end caps 44', 46' to receive fasteners 76' therethrough which are further received in the blade channel 68', 69' to interconnect the end caps 44', 46' and the diffuser blades 38'.

Referring to FIG. 8, the alternative embodiment also includes a blockage flange 54' having a predetermined width and extending axially outwardly from the top portion of each of the end caps 44', 46' for engaging a like adjacent blockage flange 54' of an adjacent diffuser 20' and creating an air barrier for preventing air flow through the air gap at 53' between the plenum outlets 36*a*', 36*b*' and between the adjacent diffuser assemblies 20'. Further, an engagement flange 56' having a predetermined width less than the blockage flange width and extending axially outwardly from the bottom portion of each of the end caps 44', 46' creates a clearance space or gap between the flanges 56' for receiving a transverse T-shaped support bar 28' therebetween. As shown, the width of the flanges 54', 56' extending outwardly from the end caps 44',46' extending outwardly from the end caps 44',46' is greater than the width of the preferred embodiment flanges 54, 56 to accommodate for a greater width of the T-bar 28'. Furthermore, as previously discussed, the end caps 44', 46' are spaced vertically above the horizontal third portion 66' of the diffuser blades 38', equivalent to the thickness of the horizontal support plate 30' of the T-bar 28' such that the plate 30' and blades 38' remain flush in the suspended ceiling.

Figure 10:
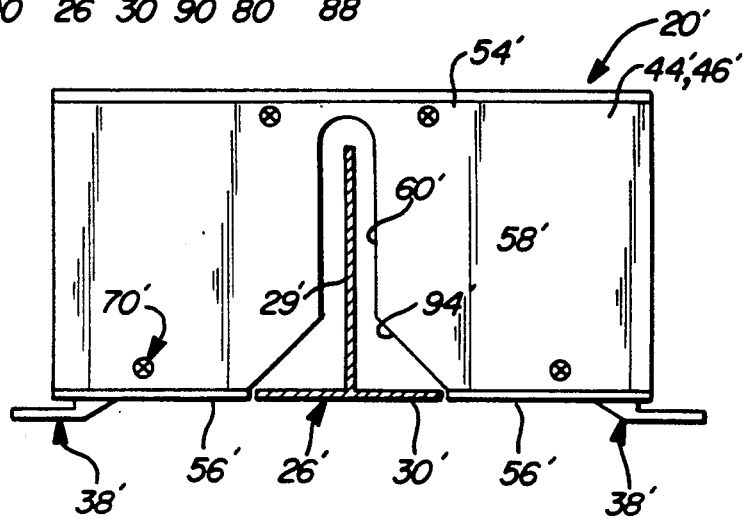
FIG. 10 is an end view of an alternative embodiment of the subject invention.

Turning to FIG. 10, an end cap 44', 46' of the alternative embodiment is shown including the blockage flange 54' and engagement flange 56'. The end cap 44', 46' further includes a U-shaped slot 60' extending through the face plate 58' and spaced from the flanges 54', 56'. Additionally, a V-shaped slot 94' in the face plate 58' extends from the bottom portion of the end cap 44', 46' adjacent the engagement flange 56' to the U-shaped slot 60'. The U-shaped slot 60' receives the longitudinal vertical shank portion 29' of the T-bar 26' and the V-shaped slot 94' allows the horizontal support plates 30' of the axial T-bar 26' to rest parallel with the engagement flange 56' and thus alleviate interference with the transverse T-bar 28' supporting the engagement flange 56' and diffuser assembly 20'.

Figure 12:
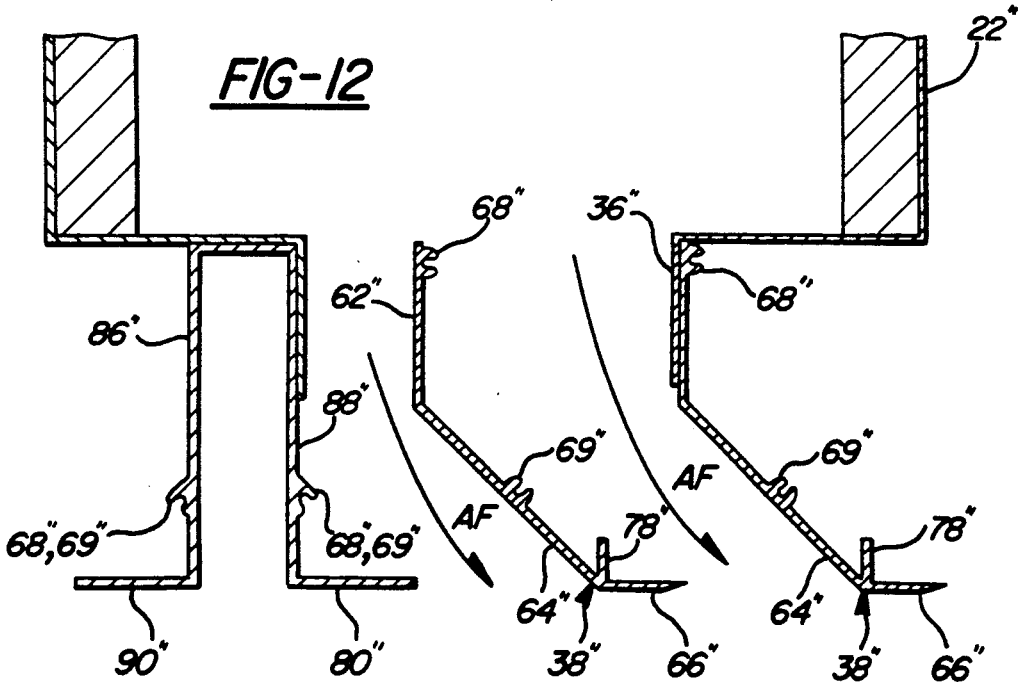
FIG. 12 is an end view of yet another alternative embodiment of the air plenum outlet and the air diffuser with the end cap removed.
Figure 14:
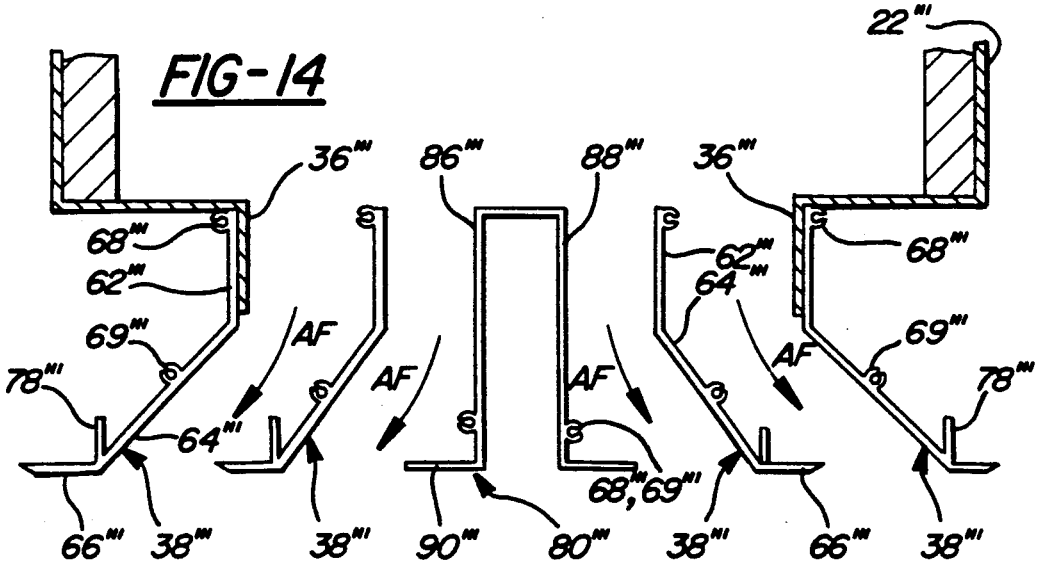
FIG. 14 is an end view of yet another alternative embodiment of the air plenum outlet and the air diffuser with the end cap removed.
Figure 15:
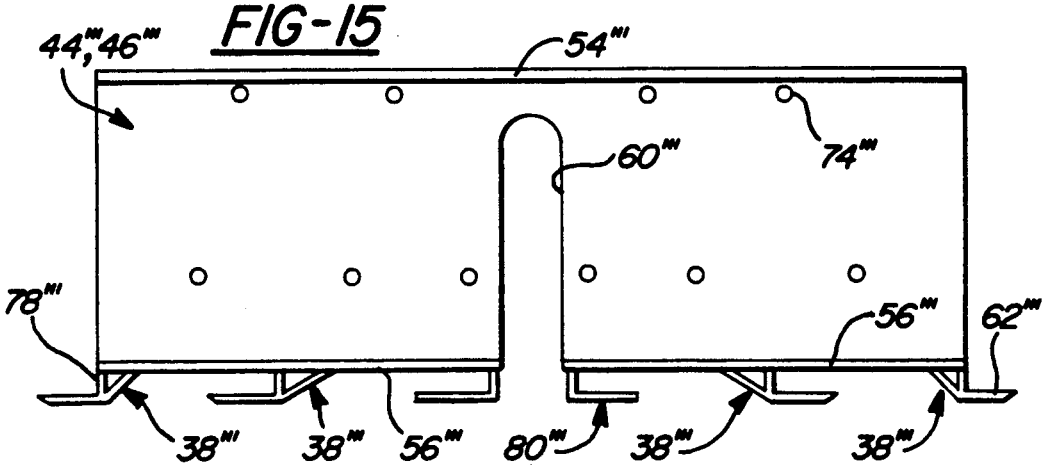
FIG. 15 is an end view of the alternative embodiment of FIG. 14 with the end cap connected.

It will be appreciated that any number of air diffuser blades 38 may be longitudinally positioned in the air diffuser assembly 20 in any directional configuration between the first 44 and second 46 end caps to provide for varying direction of the conditioned air flow out of the air flow channel 48. For example, as shown in yet another alternative embodiment of FIGS. 12 and 13 including double primed denotation, an air plenum outlet 36" is shown received by an air diffuser assembly 20". The diffuser 20" includes a central diffuser member 80" and two air diffuser blades 38" positioned parallel and spaced apart forming two air flow channels 48" on the same side of the member 80" for directing air in the same direction out of the air diffuser assembly 20 as designated by the air flow directional arrows marked AF. FIG. 13 shows the end cap 44", 46" interconnecting the ends of the diffuser blades 38" and the center diffuser member 80" and aligning the U-shaped slot 60" with the channel of the center member 80" to receive the axially positioned T-bar 26". It will be appreciated, however, that any number of air diffuser blades 38 may be incorporated in the air diffuser assembly 20 for directing the conditioned air. That is, any number of air diffuser blades 38 may be positioned on opposite sides of the centered diffuser member 80 with a corresponding end cap 44, 46 for disbursing air in multi-directions out of the diffuser assembly 20. For example, FIGS. 14 and 15 show yet another alternative embodiment of the subject invention including triple primed denotation and disclosing an air plenum outlet 36''' received by a four blade air diffuser assembly 20'''. The diffuser 20''' includes a central diffuser member 80''' disposed in the air flow channel 48''' and two air diffuser blades 38''' positioned in opposite air flow directions on each side of the central member 80''' creating four air flow outlets designated by the air flow directional arrows marked AF. FIG. 15 shows an end cap 44''',46''' interconnecting the ends of the diffuser blades 38''' and including a U-shaped slot 60''' aligned with the channel of the central diffuser member 80''' for receiving a longitudinal T-bar (not shown ) axially therethrough.

Figure 16:
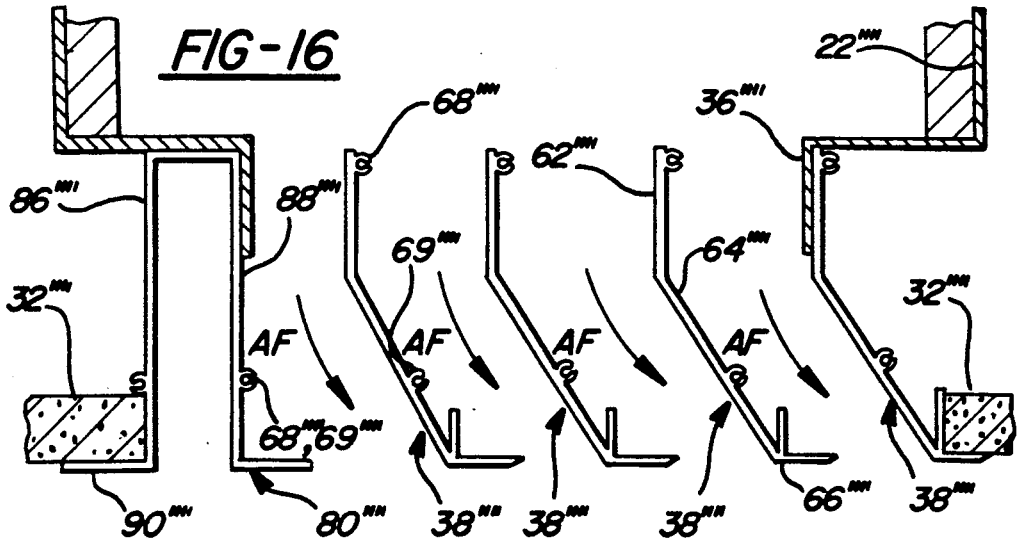
FIG. 16 is an end view of yet another alternative embodiment of the air plenum outlet and the air diffuser with the end cap removed.

Similarly, FIG. 16 shows yet another alternative embodiment of the subject invention including quadruple primed denotation and disclosing an air plenum outlet 36'''' received by a four blade air diffuser assembly 20''''. The diffuser 20'''' includes a central diffuser member 80'''' and four air flow diffuser blades 38'''' disposed in the air flow channel 48'''' and positioned in a like air flow direction on the same side of the member 80'''' dispersing air in one direction from four outlets marked by air flow directional arrows AF. An end cap (not shown) similar to the end cap 44'', 46'' of FIG. 13 interconnects the ends of the blades 38'''' and member 80''''.

The differing embodiments enables the air diffuser assembly 20 to be individualized as required for each air distribution use. Thus, the assembler is capable of assembling the diffusers 20 from a knocked down form similar to FIGS. 4 and 5 to form a desired air diffuser comprising any number of uniform air diffuser blades 38 interconnected between corresponding end caps 44,46 creating varying air distribution characteristics as shown in the numerous embodiments of FIGS. 4, 5, 12, 14 and 16.

It will further be appreciated that similar to the alternative embodiment of FIGS. 5 and 10, the center diffuser member 80 of the alternative embodiments of FIG. 13–16 may be substituted by a longitudinally extending T-bar 26' creating a central air diffuser member and a respective alternative end cap 44',46' therefore.

The invention has been described in an illustrative manner, and it is to be understood that the terminology which has been used is intended to be in the nature of words of description rather than of limitation.

Obviously many modification and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An air diffuser assembly (20) for receiving conditioned air from an air plenum (22) and dispersing the air between adjacent ceiling tiles (32) in a suspended ceiling (24) supported by a plurality of crossing T-shaped support bars (26,28), said assembly comprising:

a plurality of longitudinally extending air diffuser blades (38) for disposition in the conditioned air flow and each blade having a first (40) and second (42) end;

a first end cap (44) interconnecting each of said first ends (40) of said air diffuser blades (38) for defining a first end of an air flow channel (48);

a second end cap (46) interconnecting each of said second ends (42) of said air diffuser blades (38) for defining a second end of said air flow channel (48);

and characterized by at least one of said first (44) and second (46) end caps including engagement means (50) adjacent the bottom thereof for engaging a T-shaped support bar (28) and blockage means (52) adjacent the top thereof for engaging blockage means (52) of a next adjacent diffuser (20) having its engagement means (50) supported on the same T-shaped support bar (28) for covering the T-shaped support bar (28) and preventing the loss of air flow between the adjacent assemblies (20).

2. An assembly (20) as set forth in claim 1 further characterized by said blockage means (52) including a blockage flange (54) having a predetermined width and extending axially outwardly from the top portion of each of said end caps (44, 46) for engaging a like adjacent blockage flange (54) of an adjacent diffuser (20) creating an air barrier for preventing the flow of conditioned air between the adjacent diffuser assemblies (20).

3. An assembly (20) as set forth in claim 2 further characterized by said engagement means (50) including an engagement flange (56) having a predetermined width less than said blockage flange (54) width and extending axially outwardly from the bottom portion of each of said end caps (44, 46) creating a clearance space between said engagement flange (56) and a like adjacent engagement flange (56) for receiving the T-shaped support bar (28).

4. An assembly (20) as set forth in claim 3 further characterized by each of said first (44) and second (46) end caps including a face plate (58) for supporting said engagement flange (56) and said blockage flange (54) and for connecting and supporting each of said first (40) and second (42) ends of said air diffuser blades (38) respectively.

5. An assembly (20) as set forth in claim 4 further characterized by said face plate (58) including a generally U-shaped slot (60) extending from said engagement means (50) at the bottom portion of said end cap (44, 46) to a position spaced below said blockage means (52) at the top portion of said end cap (44,46) for receiving a T-shaped support bar (26) axially therethrough.

6. An assembly (20) as set forth in claim 5 further characterized by said air flow channel (48) having at least one inlet (37) in fluid communication with the air plenum (22) and at least one outlet (39) adjacent the ceiling tiles (32).

7. An assembly (20) as set forth in claim 6 further characterized by said air diffuser blades (38) including a first portion (62) extending vertically downwardly from the top portion of said end caps (44, 46), a second portion (64) extending outwardly from said first portion (62) at a predetermined angle to a position adjacent the bottom portion of said end caps (44, 46) and a third portion (66) extending parallel to said end cap flanges (54, 56) and spaced vertically below said engagement flange (56) of said end caps (44, 46).

8. An assembly (20) as set forth in claim 7 further characterized by including connection means (70) for interconnecting said end caps (44, 46) and said air diffuser blades (38).

9. An assembly (20) as set forth in claim 8 further characterized by said connection means (70) including at least one semi-cylindrical channel (68,69) extending longitudinally along the outside of said air diffuser blades (38) between said first (40) and second (42) ends of said blades (38).

10. An assembly (20) as set forth in claim 9 further characterized by said connection means (70) including a plurality of apertures (74) extending through each of said end cap face plates (58) in alignment with said longitudinal diffuser blade channels (68,69) and a plurality of fasteners (76) extending through said apertures (74) and received in said channels (68,69) for connecting said end caps (44, 46) to said ends (40, 42) of said diffuser blades (38).

11. An assembly (20) as set forth in claim 10 further characterized by said air diffuser blades (38) including abutment means (78) extending vertically upwardly from said third portion (66) of said blades (38).

12. An assembly (20) as set forth in claim 11 further characterized by said abutment means (78) including an upwardly extending flange (78) extending between said first (40) and second (42) diffuser blade ends, said third portion (66) of said blades (38) receiving and supporting a portion of a ceiling tile (32) and said abutment flange (78) abutting the edge of the ceiling tile (32) for preventing displacement thereof.

13. An assembly (20) as set forth in claim 12 further characterized by including a longitudinally extending center diffuser member (80) for disposition in the conditioned air flow and extending between said first and second end caps (44, 46).

14. An assembly (20) as set forth in claim 13 further characterized by said center diffuser member (80) having a first end (82) connected to said first end cap (44) by said connection means (70) and a second end (84) connected to said second end cap (46) by said connection means (70).

15. An assembly (20) as set forth in claim 14 further characterized by said center diffuser member (80) including spaced apart first (86) and second (88) side walls extending downwardly in said air flow channel (48) from the top portion of said end caps (44, 46) to said position spaced below said engagement flanges (56).

16. An assembly (20) as set forth in claim 15 further characterized by each of said first and second side walls (86,88) including a generally horizontal directional plate (90) extending outwardly from the bottom thereof for directing conditioned air through said air flow channel (48).

17. An assembly (20) as set forth in claim 16 further characterized by said center diffuser member (80) having an end plate (92) interconnecting the top portions of said first and second side walls (86,88) and creating a generally U-shaped channel therebetween for receiving a T-shaped support bar (26) axially therethrough.

18. An assembly (20) as set forth in claim 13 further characterized by including a T-shaped support bar (26) displaced in said air flow channel (48) parallel with said air diffuser blades (38) and extending axially between said first and second end caps (44, 46).

19. An assembly (20) as set forth in claim 18 further characterized by said T-bar (26) including a vertical shank portion (29) extending into said air flow channel (48) between said diffuser blades (38) and a horizontal support plate (30) extending outwardly from opposite sides of said vertical portion (29) to direct the conditioned air flow from said outlet (39) of said air diffuser (20).

20. An assembly as set forth in claim 19 further characterized by said end caps (44, 46) including a V-shaped slot (94) in said face plate (58) extending from the bottom thereof adjacent said engagement flange (56) to said U-shaped slot (60), said U-shaped slot (60) receiving said vertical portion (29) axially therethrough and said V-shaped portion (94) receiving and supporting said horizontal support plates (30) aligned and parallel with said engagement flange (56).

21. An end cap (44,46) for interconnecting the ends (40,42) of a plurality of longitudinally extending air diffuser blades (38) of an air diffuser assembly (20) supported by a plurality of crossing T-shaped support bars (26,28), said end cap (44,46) comprising:

connection means (70) for interconnecting said end cap (44,46) and the ends (40,42) of the air diffuser blades (38);

and characterized by said end cap (44,46) including engagement means (50) adjacent the bottom thereof for engaging a T-shaped support bar (28) and blockage means (52) adjacent the top thereof for engaging blockage means (52) of a next adjacent end cap (44,46) having its engagement means (50) supported on the same T-shaped support bar (28) for covering the T-shaped support bar (28) and preventing the loss of air flow between the adjacent end caps (44,46).

22. An end cap (44,46) as set forth in claim 21 further characterized by said blockage means (52) including a blockage flange (54) having a predetermined width and extending axially outwardly from the top portion of said end cap (44, 46) for engaging a like adjacent blockage flange (54) of an adjacent end cap (44,46) creating an air barrier for preventing the flow of conditioned air between the adjacent end caps (44,46) and thus between the adjacent air diffuser assemblies (20).

23. An end cap (44,46) as set forth in claim 22 further characterized by said engagement means (50) including an engagement flange (56) having a predetermined width less than said blockage flange (54) width and extending axially outwardly from the bottom portion of said end cap (44, 46) creating a clearance space between said engagement flange (56) and a like adjacent engagement flange (56) for receiving the T-shaped support bar (28).

24. An end cap (44,46) as set forth in claim 23 further characterized by including a face plate (58) for supporting said engagement flange (56) and said blockage flange (54) and for connecting and supporting the ends (40,42) of the air diffuser blades (38).

25. An end cap (44,46) as set forth in claim 24 further characterized by said face plate (58) including a generally U-shaped slot (60) extending from said engagement means (50) at the bottom portion of said end cap (44, 46) to a position spaced below said blockage means (52) at the top portion of said end cap (44,46) for receiving a T-shaped support bar (26) axially therethrough.

26. An end cap (44,46) as set forth in claim 25 further characterized by said connection means (70) including at least one semi-cylindrical channel (68,69) extending longitudinally along the outside of the air diffuser blades (38) between opposite ends (40,42) of the blades (38).

27. An end cap (44,46) as set forth in claim 26 further characterized by said connection means (70) including a plurality of apertures (74) extending through said end cap face plate (58) and in alignment with said longitudinal diffuser blade channels (68,69) and a plurality of fasteners (76) extending through said apertures (74) and received in said channels (68,69) for connecting said end cap (44, 46) to said ends (40, 42) of the diffuser blades (38).

28. An end cap (44,46) as set forth in claim 27 further characterized by including a V-shaped slot (94) in said face plate (58) extending from the bottom thereof adjacent said engagement flange (56) to said U-shaped slot (60), said U-shaped slot (60) receiving a vertical portion (29) of the T-shaped support bar (28) axially therethrough and said V-shaped portion (94) receiving and supporting a horizontal support plate (30) of the support bar (28) aligned and parallel with said engagement flange (56).

* * * * *